US006669038B1

(12) United States Patent
Zingerman

(10) Patent No.: US 6,669,038 B1
(45) Date of Patent: Dec. 30, 2003

(54) SELF-PROPELLED CRANE

(75) Inventor: David Zingerman, 1615 Wilcox Ave., Los Angeles, CA (US) 90068

(73) Assignee: David Zingerman, Los Angeles, CA (US)

( * ) Notice: Subject to any disclaimer, the term of this patent is extended or adjusted under 35 U.S.C. 154(b) by 580 days.

(21) Appl. No.: 09/638,998

(22) Filed: Aug. 14, 2000

(51) Int. Cl.[7] ..... B66C 1/00; B66C 23/06; B66C 23/64

(52) U.S. Cl. ..... 212/242; 212/232; 212/233; 212/347

(58) Field of Search ..... 212/231, 233, 212/168, 232, 347, 326, 242, 251, 272, 273, 274

(56) References Cited

U.S. PATENT DOCUMENTS

| | | | | |
|---|---|---|---|---|
| 3,140,857 A | * | 7/1964 | Nickles | 212/233 |
| 3,572,517 A | * | 3/1971 | Liebherr | 212/347 |
| 4,063,649 A | | 12/1977 | Hubbad et al. | |
| 4,565,292 A | * | 1/1986 | Spengel, Sr. | 212/232 |
| 4,673,093 A | | 6/1987 | Van Ketel | |
| 4,892,202 A | * | 1/1990 | Hey et al. | 212/232 |
| 5,018,630 A | * | 5/1991 | McGhie | 212/233 |
| 5,314,262 A | | 5/1994 | Meisinger et al. | |

FOREIGN PATENT DOCUMENTS

| | | | | |
|---|---|---|---|---|
| DE | 222653 | * | 5/1985 | 212/343 |
| SU | 1977110 | * | 10/1977 | 212/242 |

* cited by examiner

*Primary Examiner*—Eileen D. Lillis
*Assistant Examiner*—R. B. Johnson

(57) ABSTRACT

A self-propelled crane provides a possibility to lift the heavy and large-size loads and includes a mobile unit as a base unit, which carries a pivoting platform, a traverse, a boom, the bottom of which is by the hinge connected to the platform and the upper end of a boom is attached to a luffing arm. The upper end of the boom has the first hoist cable roller and another end of the luffing arm has the second hoist cable roller. The first hoist cable is connected to a crane hook mechanism. The traverse, comprising a truss connected by the traverse hinge to a frame which is by the slings connected to the load, is suspended on the second hoist cable passing via the traverse roller to the hook mechanism

4 Claims, 2 Drawing Sheets

(a prior art)

SELF-PROPELLED CRANE

FIELD OF THE INVENTION

This invention relates to the self-propelled cranes and more particularly to self-propelled cranes with non-telescopic boom.

BACKGROUND OF THE INVENTION

The various types of cranes are well known. In order to lift the heavy and most important large-size load are used the cranes and derricks with luffing jib and/or cranes with a telescopic main boom. Some cranes for increasing of the boom luffing characteristics use a luffing jib section in addition to the telescopic boom, as it is mentioned, for example, in the U.S. Pat. No. 4,063,649. Accordingly to this patent the mobile crane has a telescopic boom comprising a lower section, an intermediate section slidable telescopically within the upper end of the lower section and an upper section slidable telescopically within the upper end of the intermediate section. Extension means such as hydraulic rams are provided to position the intermediate section with respect to the lower section and the upper section with respect to the intermediate section so that the overall length of the telescopic boom may be adjusted to any desired value between a maximum and a minimum limit.

The lower end of the boom intermediate section is pivoted to a horizontal base unit so as to permit luffing movement of the boom.

The base unit is mounted upon a road vehicle chassis and is arranged for rotation with respect to the chassis about a vertical axis on a slewing center.

For basic duties of the crane, a load is suspended by a hoist rope which passes over a sheave at the outer end of the boom upper section to a winding drum. By varying the extension of the boom and/or the luff angle, the horizontal distance between the slewing center and the hoist rope can be varied so as to permit the lifting of loads located within a range of radius of action from the slewing center.

For fly duties of the crane in order to increase a range of radius of action from the stewing center for lager size load lifting, is used an additional luffing jib (fly jib), which is secured to the outer end of the boom intermediate section and the hoist rope (cable) passes over a sheave at the fly jib outer end. For any combination of telescopic boom extension and fly jib the distance between the slewing center and the hoist rope new position at the end of the fly jib is greater than the corresponding value of the distance between the slewing center and the hoist rope position at the end of boom upper section.

Such modification (supplementary equipment) provides increasing of boom-out, but leads to decreasing of the lifting load weight considering weak and non-moored construction of the fly jib, and also requires the reinstallation operations for crane basic duties and for crane fly duties. The crane supplementary equipment presented in the U.S. Pat. No. 4,673,093 is for mooring a crane and is intended to provide a heavy load lifting by the assembly of interconnected guy wires (cable) between a gay mast, which is not connected to a luffing jib and not directly connected to a main boom, and long, massive stationary crane foundation (e.g. pontoon). The possibility to lift large-size load in such crane is provided by the standard luffing jib.

These types of cranes have complex mooring system comprising the separate gay cable and luffing cable, requiring additional hoist blocks and frames and the described improvements by the mentioned U.S. Pat. No. 4,673,093 is not applicable for the mobile cranes, which has mostly a boom and not provided by the expensive luffing jib system.

As has been mentioned above, the most of the small and medium self-propelled cranes (mobile cranes) have a boom and do not include a luffing jib, being unable to lift a large-size load, as shown, for example, on FIG. 1 (on the drawing is presented a hypothetical/conventional lifting of the load).

Some cranes have a need to arrange the large-size load for lifting. The hoisting arranging equipment for large-size load is described in the U.S. Pat. No. 5,314,262. According to the invention, a supplemental equipment for load arrangement includes two motor driven cable drums, fixed cable points associated with the load arranged on the frame of the load, cable rollers arranged on a roller support, as well as hoisting cables guided between the cable fixed points and the cable drums. The cable drums are of a double-thread design wherein each of the cable drums feeds of two cables. The cable drums, together with their drives, are supported on the load in parallel and offset by a drum diameter. The distance between the cable supported by a first drum and cable supported by a second drum approximately corresponds to a spacing distance between a first set of rollers and second set of rollers on the roller support when the cable drum is fully wound with cable (the roller support and spreader are in an upper most position). The distance between the cable fixed points of cables from the first drum and the fixed points of cables from the second drum likewise corresponds approximately to the distance between the first set of cable rollers and the second set of cable rollers. The first set of cables on the first drum and the second set of cables on the second drum run off the drum in an inward direction (the first set of cables move inwardly, towards the second set of cables and the second set of cables move inwardly towards the first set of cables as they run off during lowering).

Such load arranging supplementary equipment is complex and expensive.

Thus, the known small and medium self-propelled cranes can not provide the lifting of heavy and large-size loads.

OBJECT AND ADVANTAGES OF THE INVENTION

Accordingly, several objects and advantages of the present invention are to provide an improved self-propelled crane to lift the heavy and large-size loads.

It is another object of the invention to increase the self-propelled crane possibility to lift the loads with the higher weights.

It is still another object of the invention to provide the increased the luffing of the small and medium self-propelled cranes.

It is further object of the invention to increase the self-propelled crane possibility to lift the loads with the larger sizes.

It is still further object of the invention to provide the horizontal level of the lifting loads.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

This invention provides a possibility to lift the heavy and large-size (oversize) loads. An improved self-propelled crane includes a mobile unit as a base unit, which carries a pivoting platform, a traverse, a boom, the bottom of which is by a hinge connected to the platform and the upper end of a boom is attached to a luffing arm. The upper end of the boom has the first hoist cable (rope) roller and another end of the luffing arm has the second hoist cable roller. The first hoist cable is connected to a crane hook mechanism. The traverse, comprising a truss connected by the traverse hinge to a frame which is by the slings connected to the load, is suspended on the second hoist cable passing via the traverse rollers to the crane hook mechanism.

DESCRIPTION OF THE PREFERRED EMBODIMENTS

Figure 1:
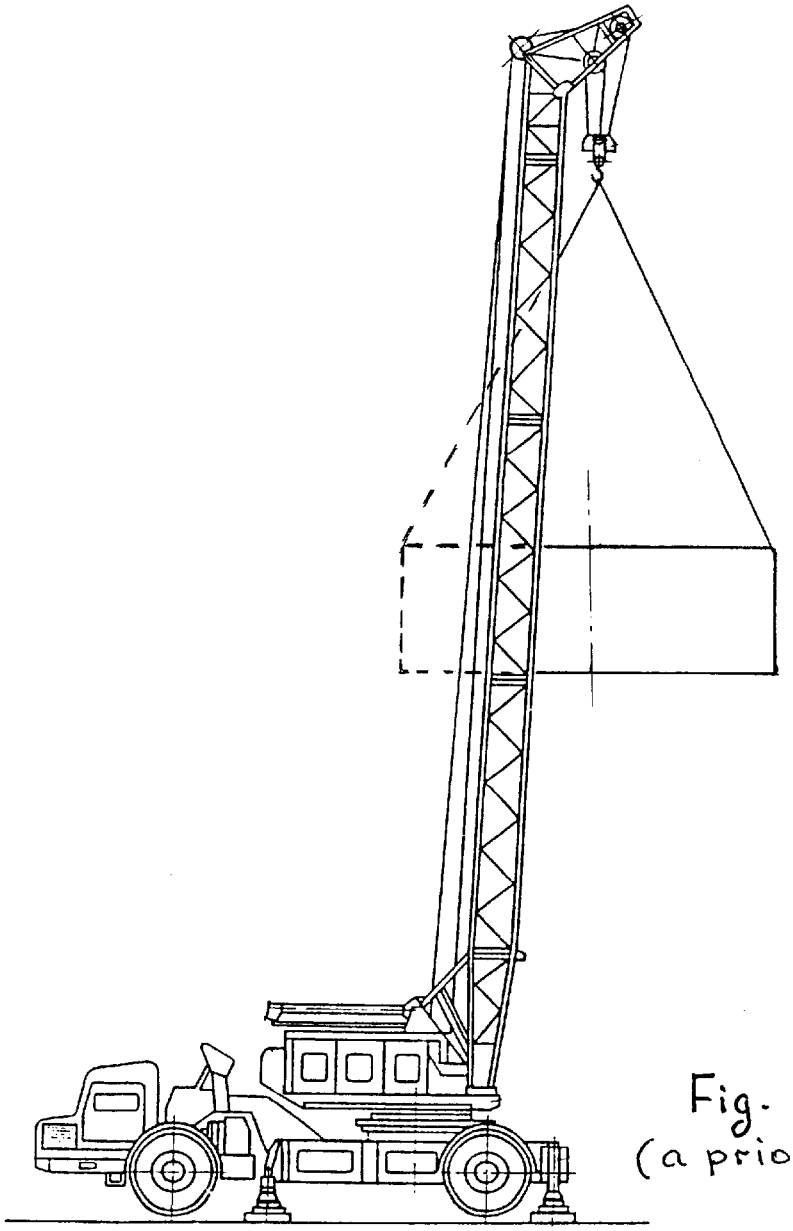
FIG. 1 is a simplified representation of the self-propelled crane deficiency (prior art).
Figure 2:
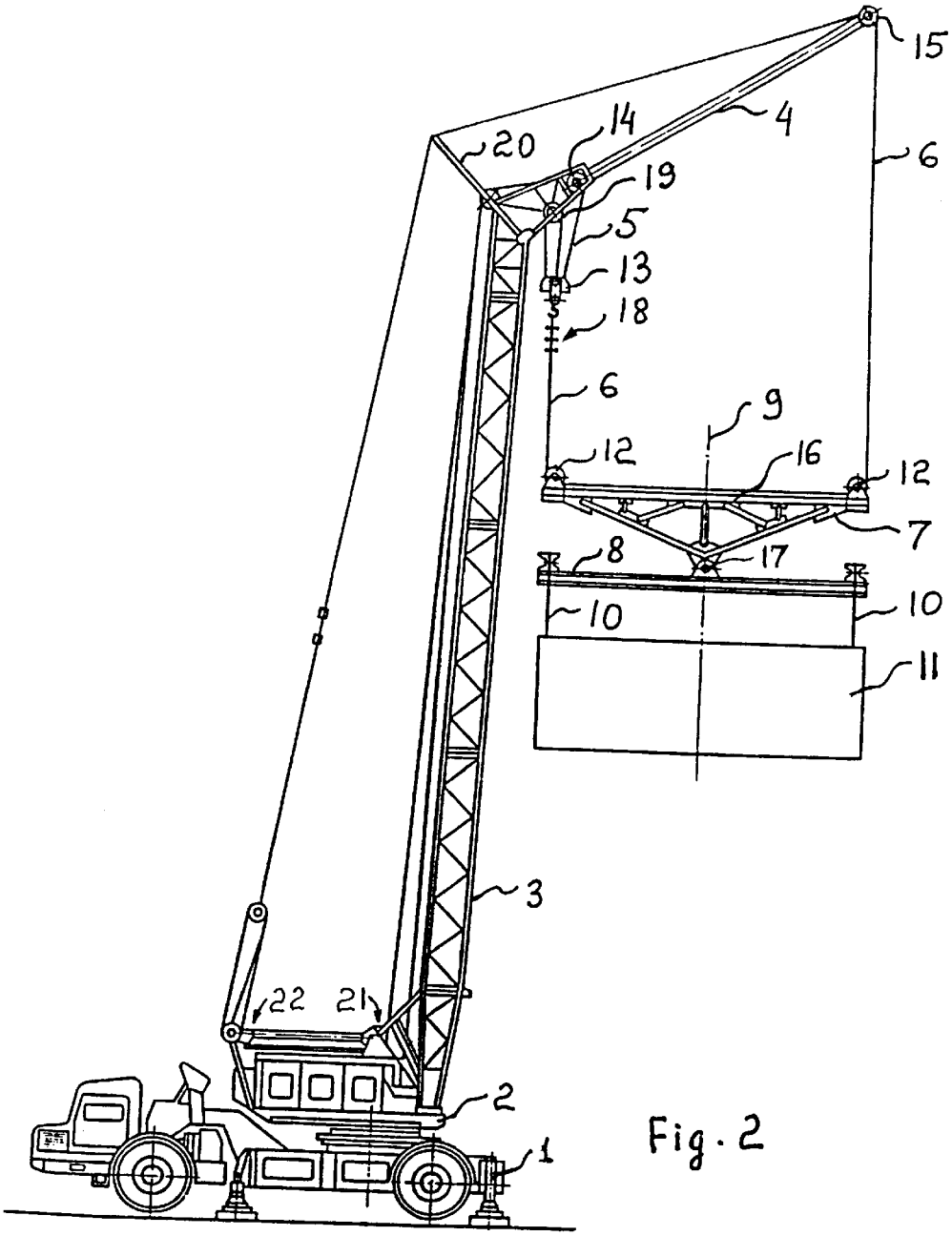
FIG. 2 is a simplified drawing of the improved self-propelled crane.

An improved self-propelled crane includes a mobile unit 1 as a base unit, which carries a pivoting platform 2, a boom 3. The bottom of the boom 3 is by the hinge connected to the platform 2 and the upper end of a boom 3 is attached to a luffing arm 4. The upper end of the boom 3 has the first hoist cable (rope) roller 14 and another end of the luffing arm has the second hoist cable roller 15. The mechanism, providing the lifting operations, includes the electrical motors (not shown) respectively coupled with the first 21 and second 22 winches, which are respectively coupled with the first 5 and second 6 hoist cables. The inner end of the first hoist cable 5 is connected to the first winch and the outer end of the first hoist cable 5 is connected to a crane hook mechanism 13. The block 19 can be installed between a boom roller 14 and hook mechanism 13 (first nook mechanism). The traverse 16, comprising a truss 7 connected by the traverse hinge 17 to a frame 8 which is by slings 10 connected to the load 11, is suspended on the second hoist cable 6 passing via the traverse rollers 12 to the hook mechanism 13. The inner end of the second hoist cable 6 is connected to the second winch and the outer end of the first hoist cable 6 is coupled to a crane hook mechanism 13. The improved self-propelled crane includes at least one of a plurality of second hoist cable gay 20, the bottom end of which is connected to the boom 3 and the upper end comprises a roller (not shown). The bottom end of the second hoist cable gay 20 can be connected to the boom 3 by the hinge (not shown). The set of traverse rollers 12 (on FIG. 2 the set of traverse rollers 12 is presented by two rollers in line) can, for example, include at least one roller located at the traverse center or a plurality of the rollers, for instance, 3 rollers in line and more, depending on the weight of load and strength of the truss 7. The traverse hinge 17 is located along axis 9 of the traverse gravity center. The connection of the "free" (outer) end of the second hoist cable 6 to the first hoist cable hook 13 can, for example, be provided by the kink clipped by the removable bolt-brace connector 18 (or by gripping connection, etc.).

The improved self-propelled crane operates as follow. The self-propelled crane can operate in three modes depending on the crane winches activity. According to the first mode, the load lifting is provided by the first winch 21 and first hoist cable 5. In this mode the first winch 21 is active and, for example, when the first hoist cable 5 goes up, the traverse 16 is rolled on the traverse rollers (blocks) 12 going up thereby lifting the load 11. In compliance with the second mode, second winch 22 is active and when the second hoist cable 6 goes up the traverse 16 is rolled on the traverse rollers 12 going up thereby lifting the load 11. The third mode is related with the both winches activity. In this mode the first 5 and second 6 hoist cables go up, pulling up the traverse 16 connected to the load 11. Also possible variation of the crane winches activity, for example, the winches activity in sequence.

Thus, by an improved self-propelled crane provides the lifting of the heavy and large-size loads.

CONCLUSION, RAMIFICATION AND SCOPE

Accordingly the reader will see that, according to the invention, I have provided a self-propelled crane with high efficiency for lifting of heavy and large-size loads . An improved crane has various possibilities, considering activities of two hoist cables in synchronous and independent regimes.

While the above description contains many specificities, these should not construed as limitations on the scope of the invention, but as exemplification of the presently-preferred embodiments thereof. Many other ramifications are possible within the teaching to the invention. For example, an improved self-propelled crane can lift two different non-oversize loads at the same time or to provide the vertical rotation of the load in the suspended position.

Thus, the scope of the invention should be determined by the appended claims and their legal equivalents, and not by examples given.

What is claimed is:

1. A self-propelled crane, including:

a mobile unit, a lifting mechanism, comprising a first and second winches, and a pivoting platform installed on said mobile unit;

a boom, the bottom side of which is by a boom hinge connected to said platform and an upper side comprises a first hoist cable roller;

a luffing arm connected to said upper side of said boom and comprising a second hoist cable roller;

a first hoist cable extending from said first winch via said first hoist cable roller to a hook mechanism;

a traverse, comprising a truss connected by a traverse hinge to a frame, which is by a set of slings connected to a load, and wherein said traverse includes at least one of a plurality of traverse rollers, and wherein said at least one of said plurality of traverse rollers are connected to said truss;

a second hoist cable extending from said second winch via said traverse rollers to said hook mechanism.

2. The self-propelled crane of claim 1, wherein an inner end of said second hoist cable is connected to said second winch and an outer end of said second hoist cable is connected to said hook mechanism.

3. The self-propelled crane of claim 2, wherein the connection of said outer end of said second hoist cable to said hook mechanism is provided by removable bolt-brace connection.

4. The self-propelled crane of claim 1, wherein further said first hoist cable is extended from said first winch via said first hoist cable roller and a block to said hook mechanism, and wherein said block is connected to said boom.

* * * * *